US009972950B2

(12) United States Patent
Kawakami et al.

(10) Patent No.: US 9,972,950 B2
(45) Date of Patent: May 15, 2018

(54) SHIELD CASE, AND CONNECTOR HAVING THE SAME

(71) Applicant: HOSIDEN CORPORATION, Yao-shi (JP)

(72) Inventors: Yuta Kawakami, Yao (JP); Takayuki Nagata, Yao (JP)

(73) Assignee: HOSIDEN CORPORATION, Yao-shi (JP)

( * ) Notice: Subject to any disclaimer, the term of this patent is extended or adjusted under 35 U.S.C. 154(b) by 50 days.

(21) Appl. No.: 15/091,946

(22) Filed: Apr. 6, 2016

(65) Prior Publication Data

US 2016/0315427 A1 Oct. 27, 2016

(30) Foreign Application Priority Data

Apr. 22, 2015 (JP) ..... 2015-087515

(51) Int. Cl.
*H01R 24/40* (2011.01)
*H01R 24/50* (2011.01)
*H01R 13/6594* (2011.01)

(52) U.S. Cl.
CPC ..... *H01R 24/40* (2013.01); *H01R 13/6594* (2013.01); *H01R 24/50* (2013.01)

(58) Field of Classification Search
CPC .... H01R 24/40; H01R 13/6594; H01R 24/50; H01R 2103/00
USPC ..... 439/607.28, 607.35, 607.41, 607.55, 439/607.58, 63, 581, 607.57
See application file for complete search history.

(56) References Cited

U.S. PATENT DOCUMENTS 5,110,308 A * 5/1992 Nishikawa ..... H01R 4/2458 439/582
5,197,893 A * 3/1993 Morlion ..... H01R 23/688 439/101

(Continued)

FOREIGN PATENT DOCUMENTS

JP 2008-84561 A1 4/2008
JP 2014-035965 A 2/2014

OTHER PUBLICATIONS

Extended European Search Report dated Sep. 12, 2016 for the counterpart European patent application No. 16020099.4.

*Primary Examiner* — Renee Luebke
*Assistant Examiner* — Paul Baillargeon
(74) *Attorney, Agent, or Firm* — Kratz, Quintos & Hanson, LLP

(57) ABSTRACT

A shield case including a first shell having electrical conductivity and a second shell having electrical conductivity. The first shell includes a connecting portion and a cover. The connecting portion is a tube extending in a first direction and including a first portion and a second portion. The first portion is a portion of the connecting portion on one side in a second direction, the second direction crossing the first direction. The second portion is a portion of the connecting portion on the other side in the second direction. The cover extends in the first direction contiguously from the first portion of the connecting portion and includes a pair of walls opposed to the second portion, with interstices left between the respective walls and the second portion. The second shell includes a first blocking portion, the first blocking portion blocking the interstices.

21 Claims, 13 Drawing Sheets

(56) References Cited

U.S. PATENT DOCUMENTS

| | | | | |
|---|---|---|---|---|
| 5,215,470 | A * | 6/1993 | Henry | H01R 13/5045 439/581 |
| 6,116,914 | A * | 9/2000 | Koide | H01R 13/432 439/581 |
| 6,659,801 | B2 * | 12/2003 | Nishio | H01R 13/6581 439/607.48 |
| 6,821,150 | B2 * | 11/2004 | Hall | H01R 9/0515 439/108 |
| 7,150,648 | B1 * | 12/2006 | Hall | H01R 24/50 439/581 |
| 9,379,494 | B1 * | 6/2016 | Hu | H01R 13/6594 |
| 2007/0224883 | A1 | 9/2007 | Chan et al. | |
| 2011/0223813 | A1 * | 9/2011 | Shian | H01R 24/50 439/733.1 |

* cited by examiner

SHIELD CASE, AND CONNECTOR HAVING THE SAME

CROSS-REFERENCE TO RELATED APPLICATIONS

The present application claims priority under 35 U.S.C. § 119 of Japanese Patent Application No. 2015-087515 filed on Apr. 22, 2015, the disclosure of which is expressly incorporated by reference herein in its entity.

BACKGROUND OF THE INVENTION

Technical Field

The invention relates to shield cases, and connectors having the shield cases.

Background Art

A conventional connector is described in Japanese Unexamined Patent Publication No. 2008-84561. The connector includes a terminal, a body, and a shield case. The terminal is a generally L-shaped metal plate. The body of an insulating resin holds a middle portion of the terminal. The body and the terminal are housed in the shield case.

The shield case has a connecting portion and a mounting portion. The connecting portion is a rectangular tube connectable to a mating connector, and houses a front portion of the terminal protruding from a body. The mounting portion is a box having an open bottom, connected to the connecting portion and mounted on a circuit board.

SUMMARY OF INVENTION

The connecting portion is the rectangular tube, while the mounting portion has a pair of side walls, which are rectangular plates extending to the circuit board. If the shield case is formed by stamping a metal plate, the portion between the lower portion of the connecting portion and the side walls of the mounting portion may be cut to form a gap. This gap contributes to degradation of electro-magnetic compatibility (EMC) characteristics of the connector.

In view of the above circumstances, the invention is devised to provide a shield case with improved EMC characteristics, and to provide a connector having the shield case.

A shield case of an aspect of the invention includes a first shell having electrical conductivity and a second shell having electrical conductivity. The first shell includes a connecting portion and a cover. The connecting portion is a tube extending in a first direction and including a first portion and a second portion. The first portion is a portion of the connecting portion on one side in a second direction, the second direction crossing the first direction. The second portion is a portion of the connecting portion on the other side in the second direction. The cover extends in the first direction contiguously from the first portion of the connecting portion and includes a pair of walls opposed to the second portion, with interstices left between the respective walls and the second portion. The second shell includes a first blocking portion, the first blocking portion blocking the interstices.

The shield case of this aspect has improved EMC characteristics. This is because the first blocking portion of the second shell blocks the interstices between the second portion of the connecting portion and the walls of the cover of the first shell.

The second portion of the connecting portion may include an opposing face opposed to the walls of the cover with the interstices therebetween. The walls of the cover may include opposing faces opposed to the second portion of the connecting portion with the interstices therebetween. The first blocking portion may fit between the second portion and the walls such as to abut on the opposing face of the second portion and the opposing faces of the walls. The shield case of this aspect has further improved EMC characteristics. This is because the first blocking portion abuts on the opposing face of the second portion and the opposing faces of the walls.

The cover may further include a roof extending in the first direction contiguously from the first portion of the connecting portion. The roof may include first and second end portions in a third direction, the third direction crossing the first and second direction. The first and second end portions may each have an abutting face located on one side in the second direction of each interstice. The walls of the cover may respectively extend from the first and second end portions of the roof to the other side in the second direction. The first blocking portion may fit between the second portion and the walls such as to abut on the opposing face of the second portion, the opposing faces of the walls, and the abutting faces of the roof. The shield case of this aspect has further improved EMC characteristics. This is because the first blocking portion abuts on the opposing face of the second portion, the opposing faces of the walls, and the abutting faces of the roof.

Alternatively, the second portion of the connecting portion may have an outer face. The first blocking portion may abut on the outer face of the second portion and the opposing faces of the walls such as to block the interstices. The shield case of this aspect has further improved EMC characteristics. This is because the first blocking portion abuts on the outer face of the second portion and the opposing faces of the walls to block the interstices between the second portion and the walls.

The second shell may further include a second blocking portion. The first blocking portion may be located on one side in the first direction of a space between the walls such as to block the space. The second blocking portion may be located on the other side in the first direction of the space between the walls such as to block the space. The shield case of this aspect has further improved EMC characteristics. This is because both sides of the space between the walls in the first direction are blocked by the first blocking portion and the second blocking portion.

The cover of the first shell may have an engaging hole. The second blocking portion may include an engaging piece to be engaged with the engaging hole from the other side in the second direction. The shield case of this aspect has further improved EMC characteristics for the following reason. Engagement between the engaging piece and the engaging hole establishes electrical connection between the first shell and the second shell. As a result, the first shell and the second shell are at the same potential, so that the second shell will not electrically float.

The second blocking portion may further include a main body. The main body may block the engaging hole of the first shell from the other side in the second direction. The shield case of this aspect has further improved EMC characteristics. This is because the main body of the second blocking portion blocks the engaging hole of the first shell.

The second shell may further include a pair of walls. The walls of the second shell may each couple the first blocking portion and the second blocking portion, be disposed inside or outside the walls of the cover, and be in surface contact with the respective walls of the cover.

The walls of the second shell may be in surface contact with the walls of the cover. The shield case of this aspect has further improved EMC characteristics for the following reason. Surface contact between the walls of the second shell and the walls of the cover establishes electrical connection between the first shell and the second shell. As a result, the first shell and the second shell are at the same potential, so that the second shell will not electrically float.

According to an aspect of the invention there is provided a connector including the shield case of any one of the above aspects, a body having an insulating property and being housed in the shield case, and a terminal generally of L-shape held by the body and housed in the shield case. The connector of this aspect has improved EMC characteristics. This is because the first blocking portion of the second shell blocks the interstices between the second portion of the connecting portion of the first shell and the walls of the cover.

The terminal may include a first portion and a second portion. The first portion of the terminal may extend in the first direction such as to be disposed in the connecting portion of the first shell of the shield case. The second portion of the terminal may extend to the other side in the second direction. The second portion of the terminal may be disposed between the walls of the first shell and between the first and second blocking portions of the second shell.

The connector of this aspect has further improved EMC characteristics. This is because the first portion of the terminal is surrounded by the connecting portion, and the second portion of the terminal is surrounded by the walls of the first shell, the first blocking portion of the second shell, and the second blocking portion of the second shell.

The connector according to any one of the above aspects may further include a case having an insulating property. The case may house the shield case and have an engaging hole in communication with the engaging hole of the cover of the first shell. The engaging piece of the second blocking portion may be engaged with the engaging hole of the first shell and the engaging hole of the case.

A shield case is fixed to the case typically by engaging an engaging piece, which is formed by cutting and raising a part of the shield case, with an engaging hole or recess in the case. The cut-and-raised portion of the shield case leaves an opening in the shield case, and such an opening degrades EMC characteristics of the connector. However, in the connector of this aspect, the engaging piece of the second blocking portion is engaged with the engaging hole of the first shell, as well as the engaging hole in the case. This arrangement can obviate the need to cut and raise part of the first shell or the second shell to form an engaging piece for the purpose of fixing the first and second shells to the case. It is therefore possible to suppress degradation of EMC characteristics of the connector.

The first blocking portion of the second shell may be fixed to the body. For example, the body may have a protruding portion to be disposed between the interstices. The first blocking portion of the second shell may include a distal portion generally of U-shape. The distal portion of the first blocking portion may be configured to hold the protruding portion of the body. Alternatively, the body may have at least one slit communicating with one of the interstices. The slit of the body may be engaged with the first blocking portion of the second shell. In the connector of this aspect, the first blocking portion of the second shell is fixed to the body, preventing the second shell from falling off the body.

Figure 1A:
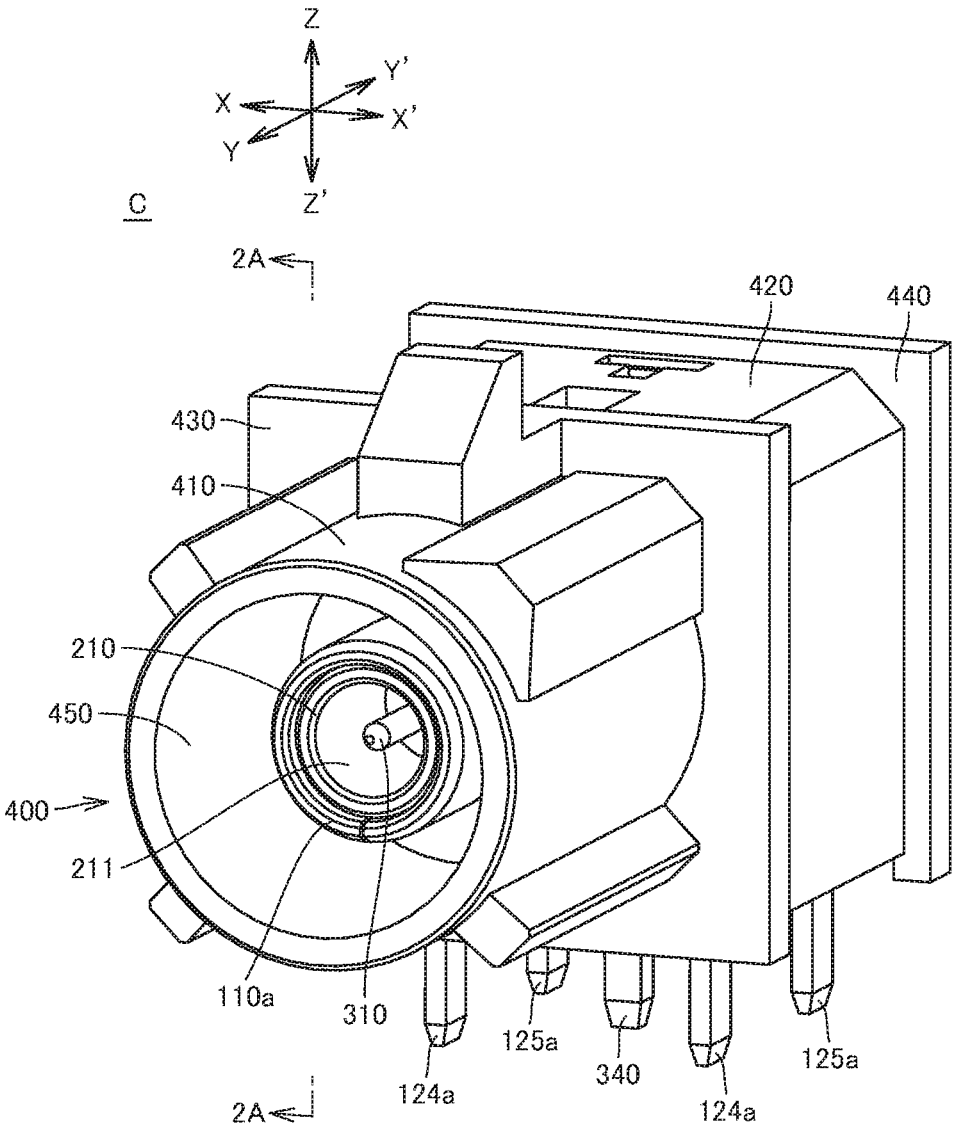
FIG. 1A is a front, top, left perspective view of a connector in accordance with the first embodiment of the invention.
Figure 1B:
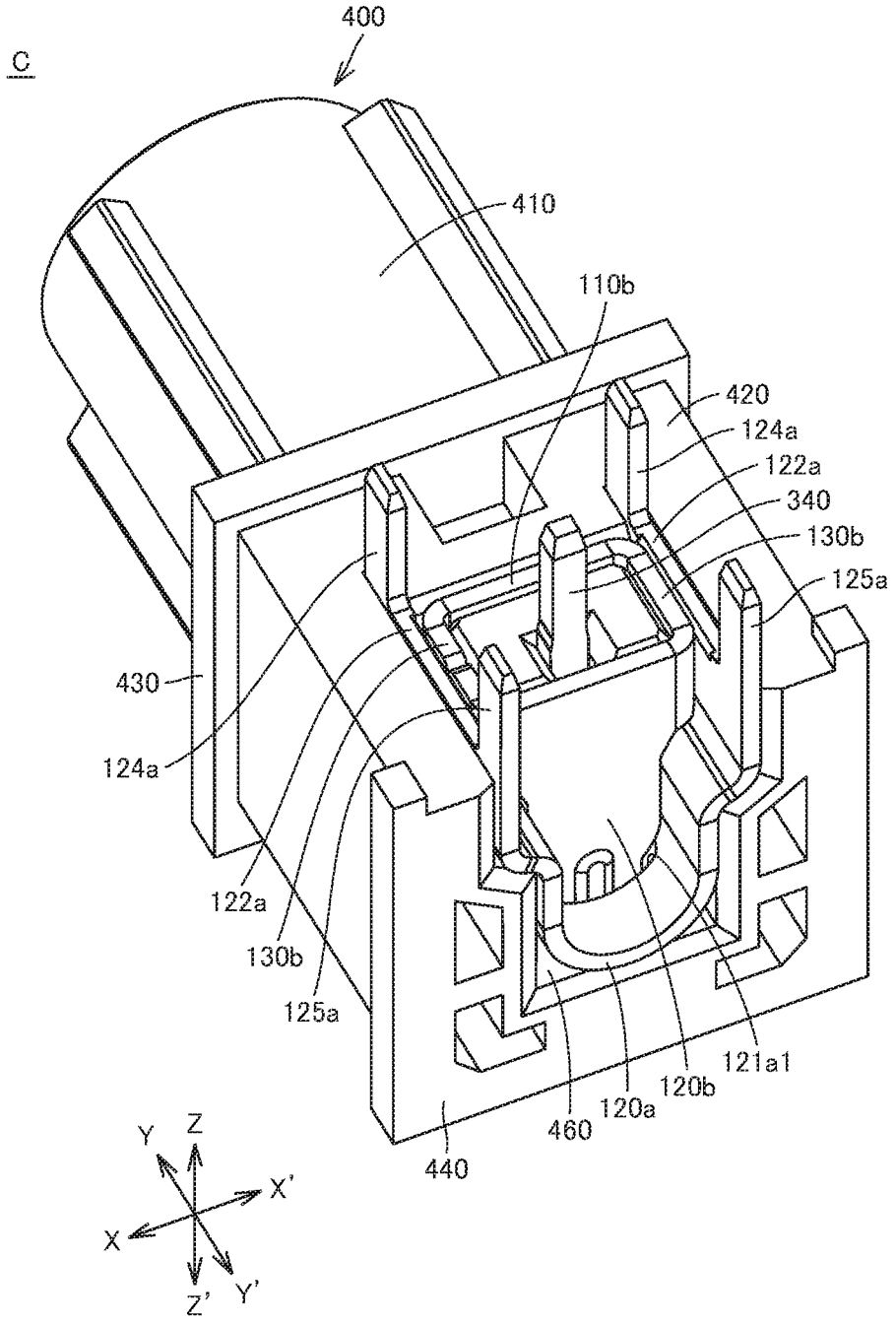
FIG. 1B is a back, bottom, right perspective view of the connector.

In the brief description of the drawings above and the description of embodiments which follows, relative spatial terms such as "upper", "lower", "top", "bottom", "left", "right", "front", "rear", etc., are used for the convenience of the skilled reader and refer to the orientation of the shield case, the connector, and their constituent parts as depicted in the drawings. No limitation is intended by use of these terms, either in use of the invention, during its manufacture, shipment, custody, or sale, or during assembly of its constituent parts or when incorporated into or combined with other apparatus.

DESCRIPTION OF EMBODIMENTS

First Embodiment

A connector C in accordance with the first embodiment of the invention will be described below with reference to FIG. 1A to FIG. 5B. The connector C includes a shield case 100, a body 200, a terminal 300, and a case 400. These constituents of the connector C will be described in detail. The Y-Y' direction indicated in FIG. 1A to FIG. 2A and FIG. 2E to FIG. 3B corresponds to the longitudinal direction of a connecting portion 110*a* (to be described) of the shield case 100 and will be referred to as a "first direction" in the claims. In the Y-Y' direction, the Y direction corresponds to one side in the first direction, and the Y' direction corresponds to the other side in the first direction. The Z-Z' direction indicated in FIG. 1A to FIG. 2A, FIG. 2D, FIG. 3A, and FIG. 3B corresponds a radial direction of the connecting portion 110*a* of the shield case 100 and will be referred to as a "second direction" in the claims. In the Z-Z' direction, the Z direction corresponds to one side in the second direction, and the Z' direction corresponds to the other side in the second direction. The Z-Z' direction is orthogonal to the Y-Y' direction. The X-X' direction indicated in FIG. 1A to FIG. 1B and FIG. 2B to FIG. 3B corresponds to another radial direction of the connecting portion 110*a* of the shield case 100 and will be referred to as a "third direction" in the claims. The X-X' direction is orthogonal to the Y-Y' direction and the Z-Z' direction.

Figure 2A:
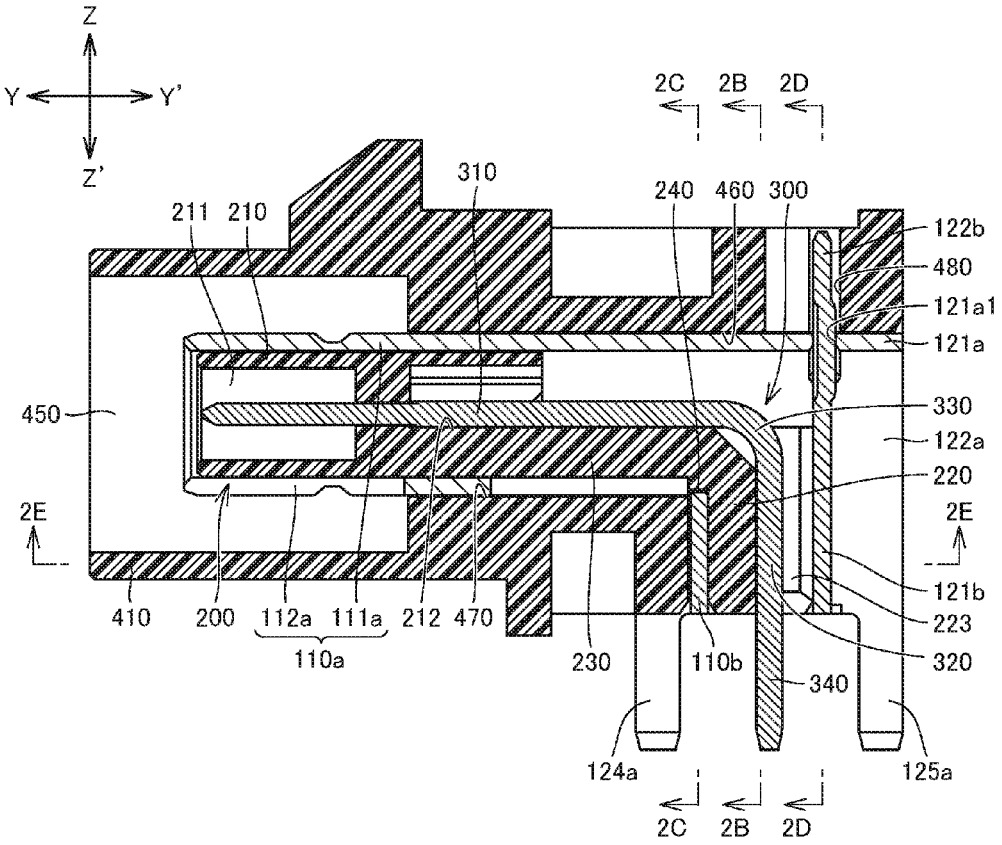
FIG. 2A is a sectional view of the connector, taken along 2A-2A in FIG. 1A.
Figure 3A:
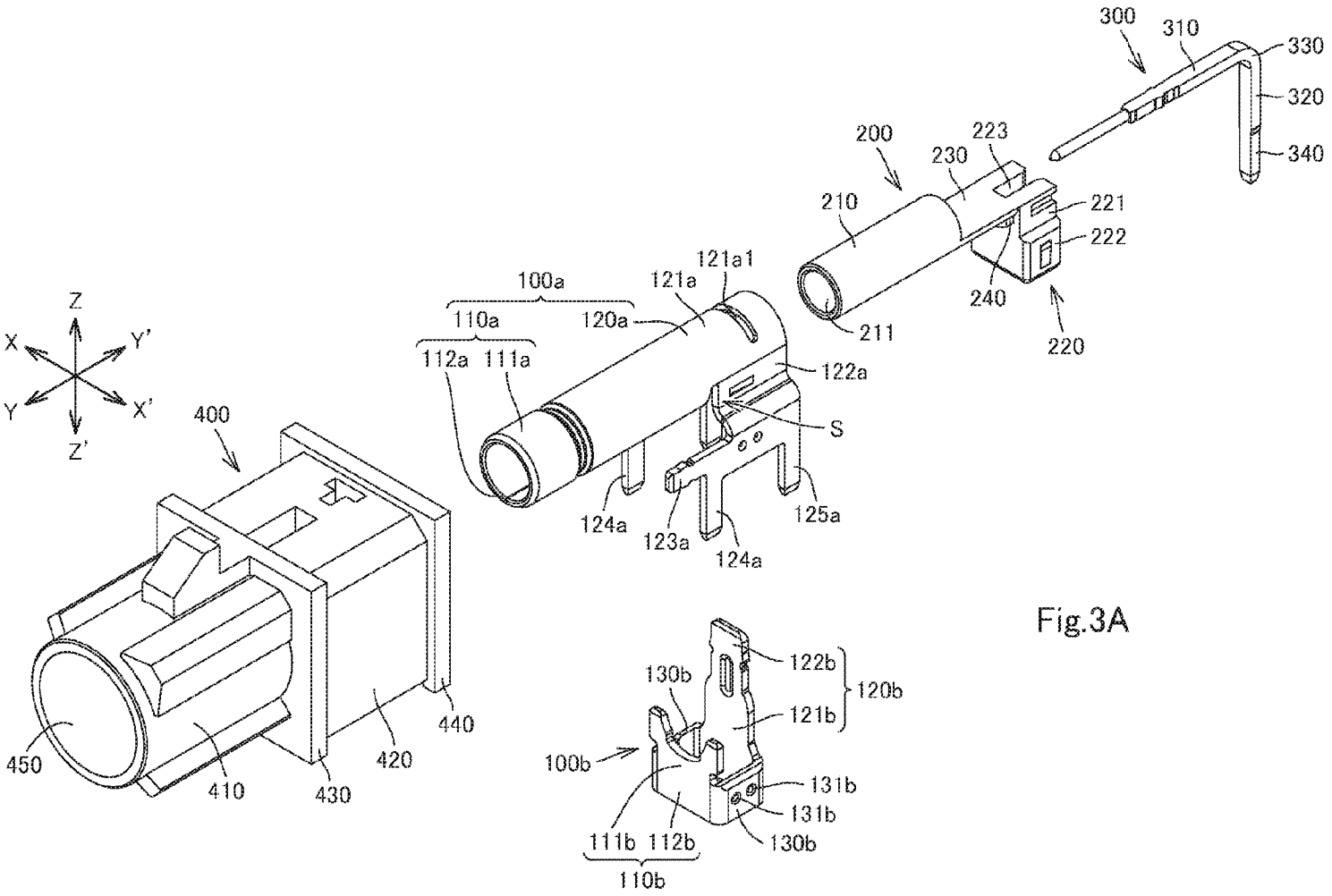
FIG. 3A is a front, top, left perspective exploded view of the connector.
Figure 3B:
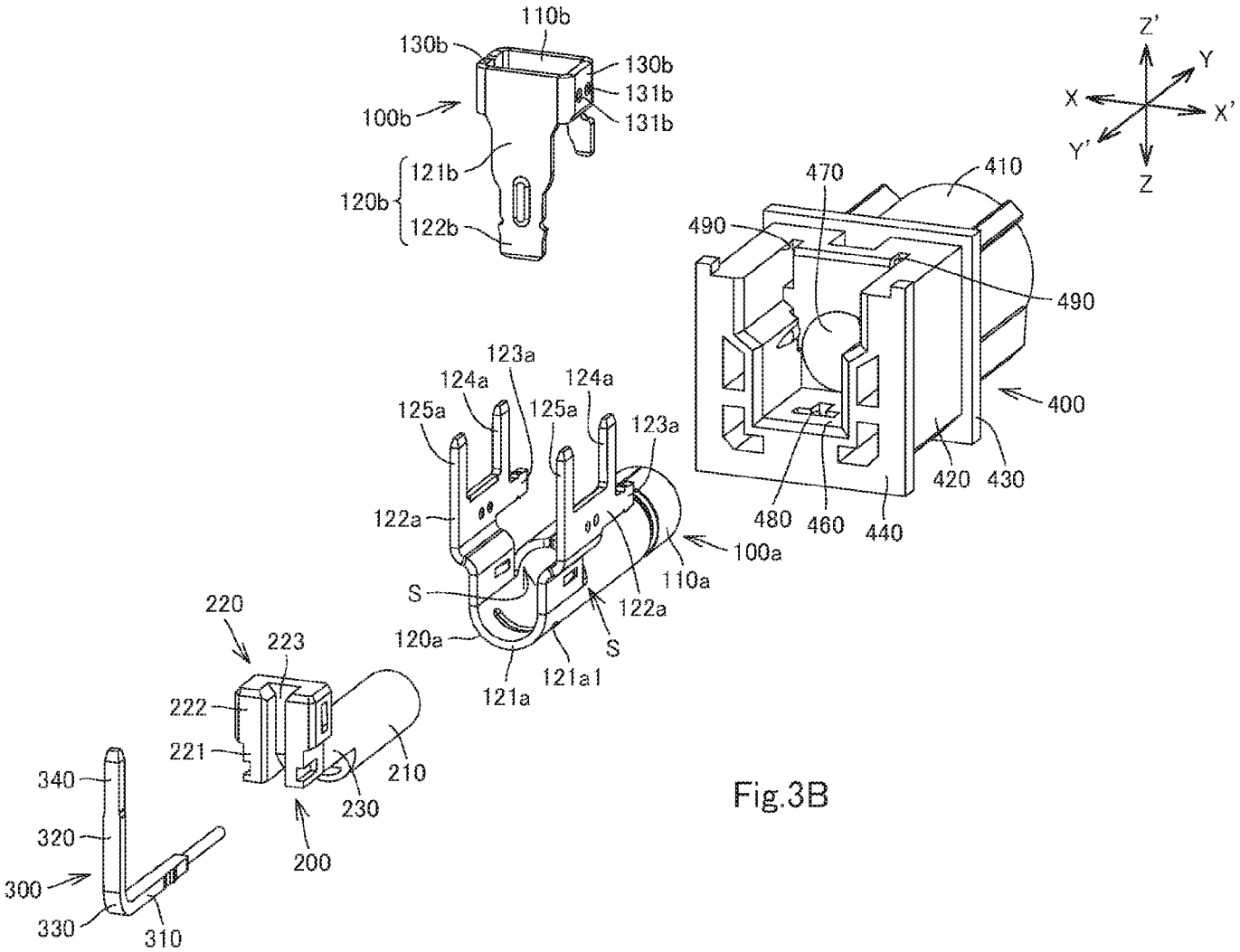
FIG. 3B is a back, bottom, right perspective exploded view of the connector.

The body 200 is made of an insulating resin. As best illustrated in FIG. 3A and FIG. 3B, the body 200 includes a connecting portion 210, a basal portion 220, and a middle portion 230. The connecting portion 210 is a block extending in the Y-Y' direction. The connecting portion 210 includes a front portion on the Y-direction side, a rear portion on the Y'-direction side, a connecting hole 211, and a lock hole 212. The connecting hole 211 extends in the Y-Y' direction in the front portion of the connecting portion 210 and opens to the Y-direction. The lock hole 212 extends in the Y-Y' direction centrally in the rear portion of the connecting portion 210 and opens to the Y-direction (see FIG. 2A). The connecting hole 211 communicates with the lock hole 212. In the first embodiment, the connecting portion 210 is a block of circular cylindrical shape, and the connecting hole 211 is a hole of circular cylindrical shape.

The basal portion 220 is a block extending in the Z-Z' direction. The basal portion 220 includes an upper portion 221, a lower portion 222, and a groove 223. The upper portion 221 is a portion on the Z-direction side of the basal portion 220. The lower portion 222 is a portion on the Z'-direction side of the basal portion 220 and contiguous with the upper portion 221. The upper portion 221 and the lower portion 222 may have the same dimension or different dimensions in the X-X' direction. In the first embodiment, the lower portion 222 has a larger X-X' direction dimension than that of the upper portion 221. The groove 223 extends in the Z-Z' direction, passing through the basal portion 220 and opening to the Y'-direction.

The middle portion 230 joins together the connecting portion 210 and the upper portion 221 of the basal portion 220. In the first embodiment, the middle portion 230 is shaped like a lower half of a circular cylinder. The middle portion 230 is located on the Z'-direction side relative to the lock hole 212 of the connecting portion 210.

As best illustrated in FIG. 3A and FIG. 3B, the terminal 300 is a generally L-shaped metal plate. The terminal 300 includes a first portion 310, a second portion 320, a bent portion 330, and a tail 340. The first portion 310 is a plate extending in the Y-Y' direction. The first portion 310 includes a front portion on the Y-direction side, a rear portion on the Y'-direction side, and a middle portion between the front portion and the rear portion. As best illustrated in FIG. 2A, the front portion of the first portion 310 is disposed inside the connecting hole 211 of the connecting portion 210 of the body 200. In the first embodiment, the front portion of the first portion 310 is disposed in the connecting hole 211 such as to extend along the central axis of the connecting hole 211. The front portion serves as a contact portion to make contact with a terminal of a mating connector. The rear portion of the first portion 310 is disposed on the middle portion 230 of the body 200. The middle portion of the first portion 310 is securely received in the lock hole 212 of the connecting portion 210.

The bent portion 330 is a generally L-shaped plate joining together the first portion 310 and the second portion 320. The bent portion 330 is received in the groove 223. The second portion 320 in the first embodiment is a plate extending from the bent portion 330 in the Z-Z' direction. Alternatively, the second portion 320 may extend in the Z-Z' direction with a slant in the Y' direction. The second portion 320 is received in the groove 223 of the basal portion 220 of the body 200. The tail 340 extends from the second portion 320 in the Z' direction and protrudes from the groove 223 in the Z' direction. The tail 340 is connectable to a through-hole electrode of a circuit board (not shown). The tail 340 may be modified such as to extend from the second portion 320 in the Y' direction and be connectable to an electrode on the circuit board.

As illustrated in FIG. 2A to FIG. 4C, the shield case 100 houses the terminal 300 and the body 200. The shield case 100 includes a first shell 100*a* and a second shell 100*b*. The first shell 100*a* is electrically conductive. The first shell 100*a* may be a metal plate formed by stamping as in the first embodiment but may alternatively be formed by casting. The first shell 100*a* includes the connecting portion 110*a* mentioned above and a cover 120*a*.

The connecting portion 110*a* is a tube extending in the Y-Y' direction. The connecting portion 110*a* is the portion adapted to fit in a connecting hole in a shell of a mating connector. The connecting portion 110*a* houses the first portion 310 of the terminal 300, the connecting portion 210 of the body 200, and the middle portion 230 of the body 200 (see FIG. 2A). The connecting portion 210 of the body 200 snugly or loosely fits in the connecting portion 110*a*. In the first embodiment, the connecting portion 210 snugly fits in the connecting portion 110*a* and holds the first portion 310 of the terminal 300. As held by the connecting portion 210, the first portion 310 of the terminal 300 is disposed in the connecting portion 110*a* such as to extend along the central axis of the connecting portion 110*a*.

The connecting portion 110*a* includes a first portion 111*a* on the Z-direction side and a second portion 112*a* on the Z'-direction side. As cut on a plane containing the Z-Z' and X-X' directions, the first portion 111*a* has a cross-section in the shape of an upper half of a circle, an arc shape, an inverted U-like shape, or an inverted V-like shape. The second portion 112*a* may be the portion excluding the first portion 111*a* of the connecting portion 110*a*), or the connecting portion 110*a* may further include another portion between the first and second portions 111*a* and 112*a*. As cut on a plane containing the Z-Z' and X-X' directions, the second portion 112*a* has a cross-section in the shape of an lower half of a circle, an arc shape, a U-like shape, or a V-like shape.

In the first embodiment, as best illustrated in FIG. 3A and FIG. 3B, the connecting portion 110*a* is a circular tube extending in the Y-Y' direction, in which the first portion 111*a* is the half of the circular tube on the Z-direction side and the second portion 112*a* is the other half of the circular tube on the Z'-direction side. In other words, as cut on a plane containing the Z-Z' and X-X' directions, the first portion 111*a* has a cross-section in the shape of an upper half of a circle, and the second portion 112*a* has a cross-section in the shape of the lower half of the circle.

As used herein, the term "upper half of a circle" includes an upper half of an ellipse, and the term "lower half of a circle" includes a lower half of an ellipse. As used herein, the term "inverted U-like shape" includes a shape consisting of an upper base and a pair of legs of a trapezoid/trapezium with the upper base being shorter than the lower base. The term "inverted U-like shape" also includes a shape consisting of an upper side and a pair of lateral sides, which is perpendicular to the upper side, of a square or rectangle (i.e.

an inverted angular U-like shape). Similarly, the term "U-like shape" includes a shape consisting of a lower base and a pair of legs of a trapezoid/trapezium with the lower base being shorter than the upper base. The term "U-like shape" also includes a shape consisting of a lower side and a pair of lateral sides, which is perpendicular to the lower side, of a square or rectangle (i.e. an angular U-like shape).

The cover 120*a* extends in the Y-Y' direction contiguously from the first portion 111*a* of the connecting portion 110*a*. The cover 120*a* includes a roof 121*a* and a pair of walls 122*a*. The walls 122*a* define a space, in which disposed are the basal portion 220 of the body 200, and the bent portion 330 and the second portion 320 of the terminal 300 (see FIG. 2A). This space corresponds to the space between the walls of the cover as defined in the claims.

The roof 121*a* extends from the first portion 111*a* in the Y' direction such as to be located on the Z-direction side relative to the basal portion 220 of the body 200, and the bent portion 330 of the terminal 300. As cut on a plane containing the Z-Z' and X-X' directions, the roof 121*a* has a cross-sectional shape that is similar shape to that of the first portion 111*a* of the connecting portion 110*a*. In the first embodiment, the roof 121*a* has a cross-section in the shape of an upper half of a circle on a plane containing the Z-Z' and X-X' directions. In other words, the roof 121*a* is shaped like a half of a circular tube. The top of the roof 121*a* is provided with an engaging hole 121*a*1. The engaging hole 121*a*1 passes through the roof 121*a* in the Z-Z' direction. The roof 121*a* further includes an X-direction end portion (first end portion of the roof) and an X'-direction end portion (second end portion of the roof).

The walls 122*a* extend in the Z' direction respectively from the X-direction end and the X'-direction end portion of the roof 121*a*. The walls 122*a* each include an upper wall 122*a*1, a lower wall 122*a*2, and a bent portion 122*a*3. The upper walls 122*a*1 are rectangular plates on the Z-direction side of the walls 122*a*. The upper walls 122*a*1 may abut on, or may face in spaced relation to, the respective side faces on the X- and X'-direction sides of the upper portion 221 of the basal portion 220 of the body 200. The upper walls 122*a*1 in the first embodiment abut on these side faces.

Figure 4A:
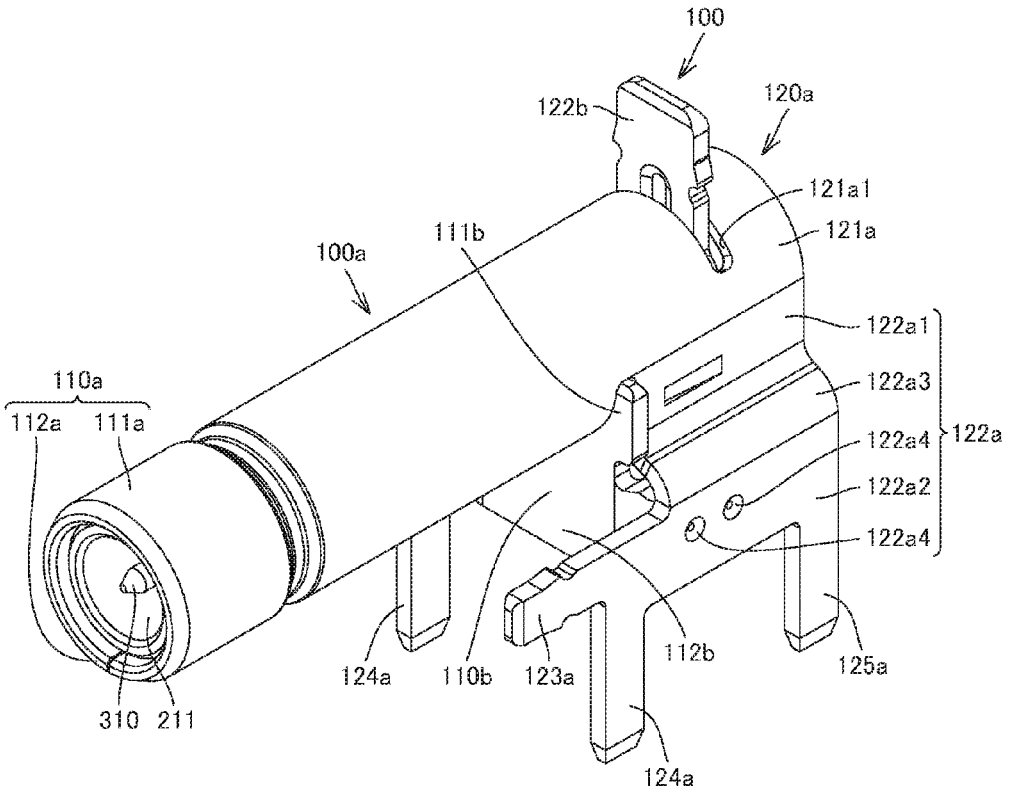
FIG. 4A is a front, top, left perspective view of a shield case and a terminal of the connector.
Figure 4B:
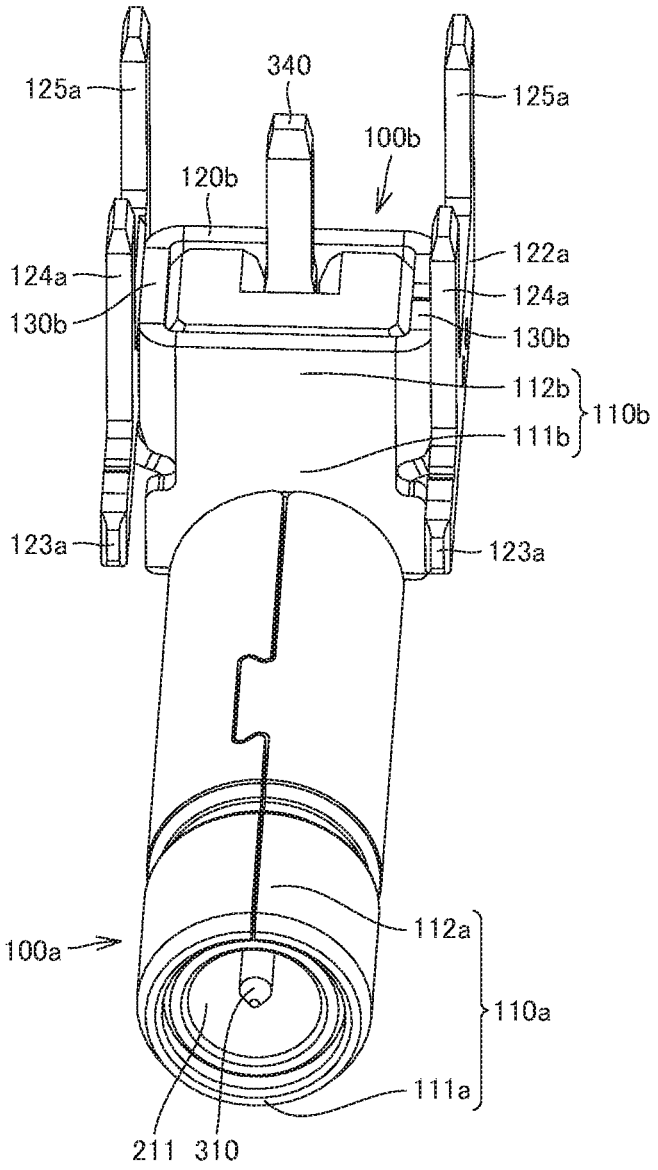
FIG. 4B is a front, bottom, right perspective view of the shield case, a body, and the terminal of the connector.
Figure 4C:
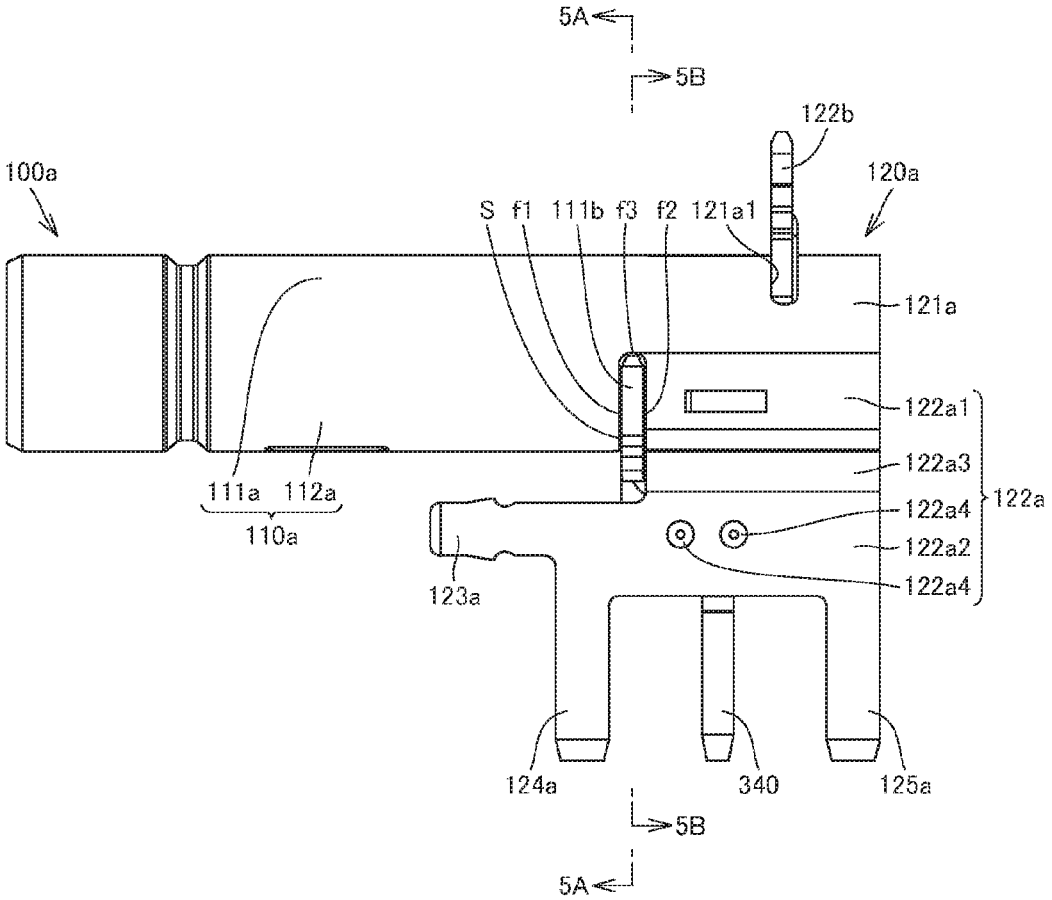
FIG. 4C is a left side view of the shield case and the terminal of the connector.

The upper walls 122*a*1 of the walls 122*a* are opposed to the second portion 122*a* of the connecting portion 110*a*, with interstices S left between the upper walls 122*a*1 and the second portion 112*a* (see FIG. 3A and FIG. 4C). If the first shell 100*a* is formed by stamping, interstices S may appear for the following reasons. It is required to form the connecting portion 110*a* in a tuboid shape and form the upper walls 122*a*1 such as to extend in the Z' direction from the roof 121*a* by a stamping process. Accordingly, the stamping process should involve separation of the upper walls 122*a*1 from the second portion 112*a* of the connecting portion 110*a*. Accordingly, when separating the upper walls 122*a*1 from the second portion 122*a*, interstices S appears between the second portion 122*a* and the upper walls 122*a*1. This is particularly true for cases where the second portion 122*a* of the connecting portion 110*a* has a cross-section on a plane containing the Z-Z' and X-X' directions, in the shape of an lower half of a circle, an arc shape, a U-like shape (excluding an angular U-like shape), or a V-like shape. For convenience of explanation, the interstices S are defined by an end face f1, a pair of end faces f2, and a pair of end faces f3. The end face f1 is an end face in the Y'-direction (opposing face) of the second portion 112*a*. The end faces f2 are respective end faces in the Y-direction (opposing faces) of the pair of upper walls 122*a*1. The end face f1 is opposed to the pair of end faces f2 in the Y-Y' direction. The end faces f3 are end faces of the X- and X'-direction end portions, respectively, of the roof 121*a* of the cover 120*a*, and they are located on the Z-direction side of the interstices S and face in the Z'-direction. The body 200 may further include a protruding portion 240. The protruding portion 240 of the body 200 may be disposed between the interstices S.

The lower walls 122*a*2 of the walls 122*a* are rectangular plates on the Z'-direction side of the walls 122*a*. The lower walls 122*a*2 can be mounted on the circuit board. The lower walls 122*a*2 has a Y-Y' direction dimension that may be the same as or different from the Y-Y' direction dimension of the upper walls 122*a*1. In the first embodiment, the lower walls 122*a*2 has a lager Y-Y' direction dimension than that of the upper walls 122*a*1. The lower walls 122*a*2 are located on the outer side relative to the upper walls 122*a*1. In other words, the distance in the X-X' direction is larger between the lower walls 122*a*2 than between the upper walls 122*a*1. Each bent portion 122*a*3 joins together each upper wall 122*a*1 and each lower wall 122*a*2. The bent portions 122*a*3 are bent such that the lower walls 122*a*2 are located on the outer side relative to the upper walls 122*a*1. The bent portions 122*a*3 can be omitted, in which case each upper wall 122*a*1 and each lower wall 122*a*2 may continuously extend a straight line in the Z-Z' direction.

The first shell 100*a* may further include a pair of arms 123*a*. The arms 123*a* extend in the Y direction from the respective lower walls 122*a*2 of the walls 122*a*. The first shell 100*a* may further include a pair of first legs 124*a* and/or a pair of second legs 125*a*. The first legs 124*a* extend in the Z' direction from the respective Y-direction end portions of the lower walls 122*a*2 of the walls 122*a*. The second legs 125*a* extend in the Z' direction from the respective Y'-direction end portions of the lower walls 122*a*2 of the walls 122*a*. The first legs 124*a* and/or second legs 125*a* may be connectable to grounding through-hole electrodes in the circuit board mentioned above. Alternatively, the first legs 124*a* and/or second legs 125*a* may extend in the X-X' direction such as to be connectable to surface electrodes on the circuit board.

The second shell 100*b* is electrically conductive. The second shell 100*b* is a separate component from the first shell 100*a*. The second shell 100*b* may be a metal plate formed by stamping as in the first embodiment but may alternatively be formed by casting.

Figure 2B:
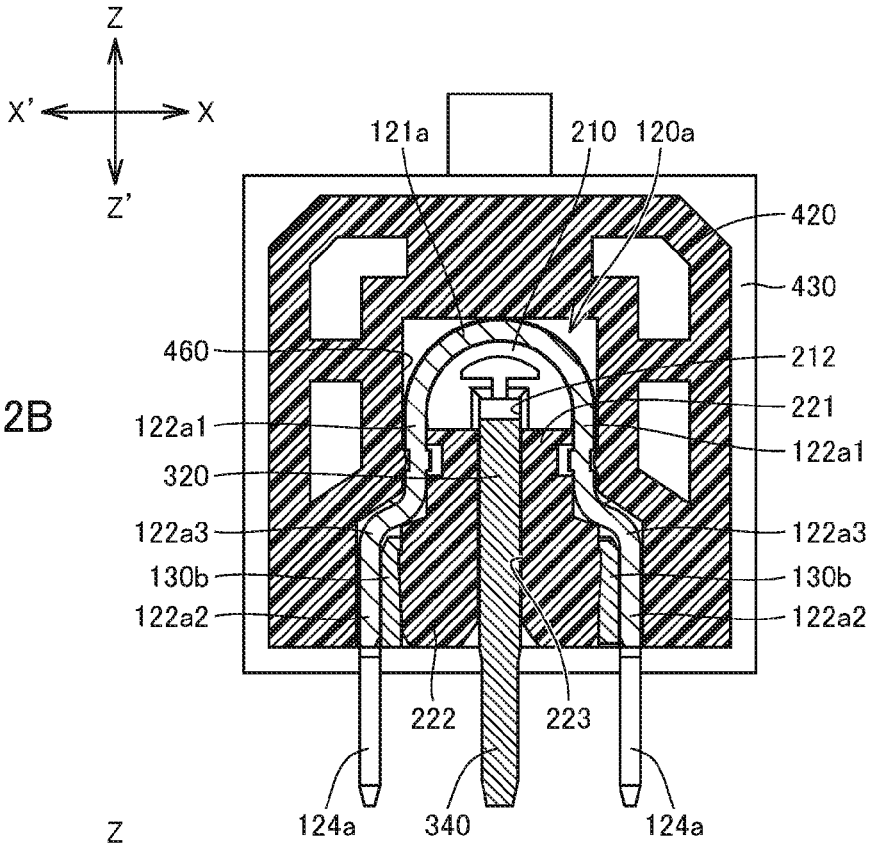
FIG. 2B is a sectional view of the connector, taken along 2B-2B in FIG. 2A.
Figure 2C:
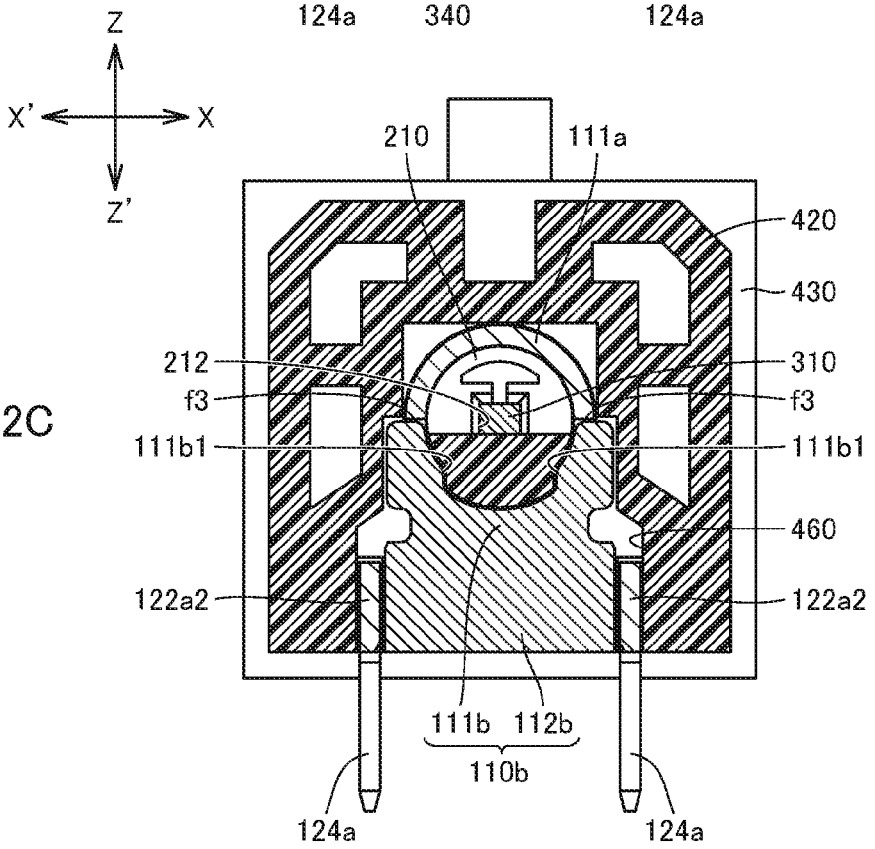
FIG. 2C is a sectional view of the connector, taken along 2C-2C in FIG. 2A.
Figure 5A:
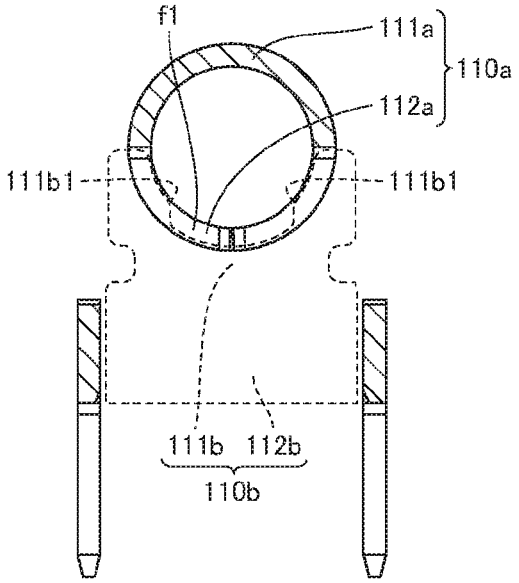
FIG. 5A is a sectional view taken along 5A-5A in FIG. 4C, illustrating the position of a connecting portion of a first shell of the shield case relative to a first blocking portion of a second shell.
Figure 5B:
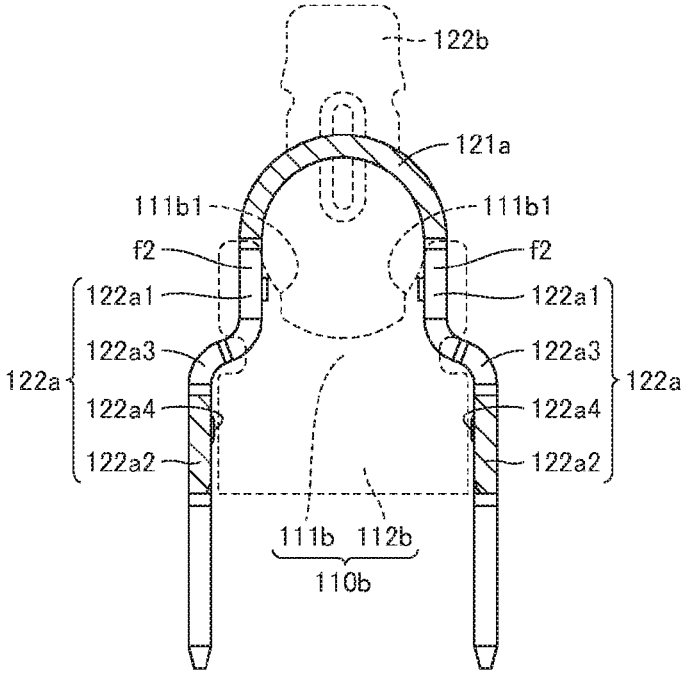
FIG. 5B is a sectional view taken along 5B-5B in FIG. 4C, illustrating the position of a cover of the first shell of the shield case relative to the first blocking portion of the second shell.

The second shell 100*b* includes a first blocking portion 110*b*. As best illustrated in FIG. 2C, FIG. 5A, and FIG. 5B, the first blocking portion 110*b* is a metal plate extending in the Z-Z' and X-X' directions. The first blocking portion 110*b* is disposed on the Y-direction side of the space between the walls 122*a* such as to block the space. The first blocking portion 110*b* includes a distal portion 111*b* and a basal portion 112*b*. The distal portion 111*b* is a generally U-shaped plate. The distal portion 111*b* has a Y-Y' direction dimension that is substantially the same as or slightly larger than the Y-Y' direction dimension of the interstices S (see FIG. 4C). The distal portion 111*b* has an X-X' direction dimension that is larger than the X-X' direction dimension of the connecting portion 110*a* and than the X-X' direction distance between the outer faces of the upper walls 122*a*1 of the pair of walls 122*a* (see FIG. 4B). The distal portion 111*b* has a recessed face. The recessed face has a cross-sectional shape, on a plane containing the Z-Z' and X-X' directions, that corresponds to the cross-sectional shape of the second portion 112*a* of the connecting portion 110*a*. The distal portion 111*b* fits between the second portion 112*a* and the upper walls 122*a*1, abutting the end face f1 of the second portion 122*a*, the end faces f2 of the upper walls 122*a*1 of the walls 122*a*, and the end faces f3 (abutting faces) of the roof 121*a*. The distal portion 111*b* thus blocks the interstices S substantially completely.

A pair of lugs 111*b*1 is provided on the recessed face of the distal portion 111*b*. The X-X' direction distance between the lugs 111*b*1 is slightly smaller than the X-X' direction dimension of the protruding portion 240 of the body 200. With the lugs 111*b*1 engaged with the protruding portion 240, the distal portion 111*b* holds the protruding portion 240, so that the first blocking portion 110*b* is fixed to the body 200.

The basal portion 112*b* has an X-X' direction dimension that is substantially the same as the X-X' direction dimension between the inner faces of the lower walls 122*a*2 of the walls 122*a*. The basal portion 112*b* abuts on the inner faces of the lower walls 122*a*2.

Figure 2D:
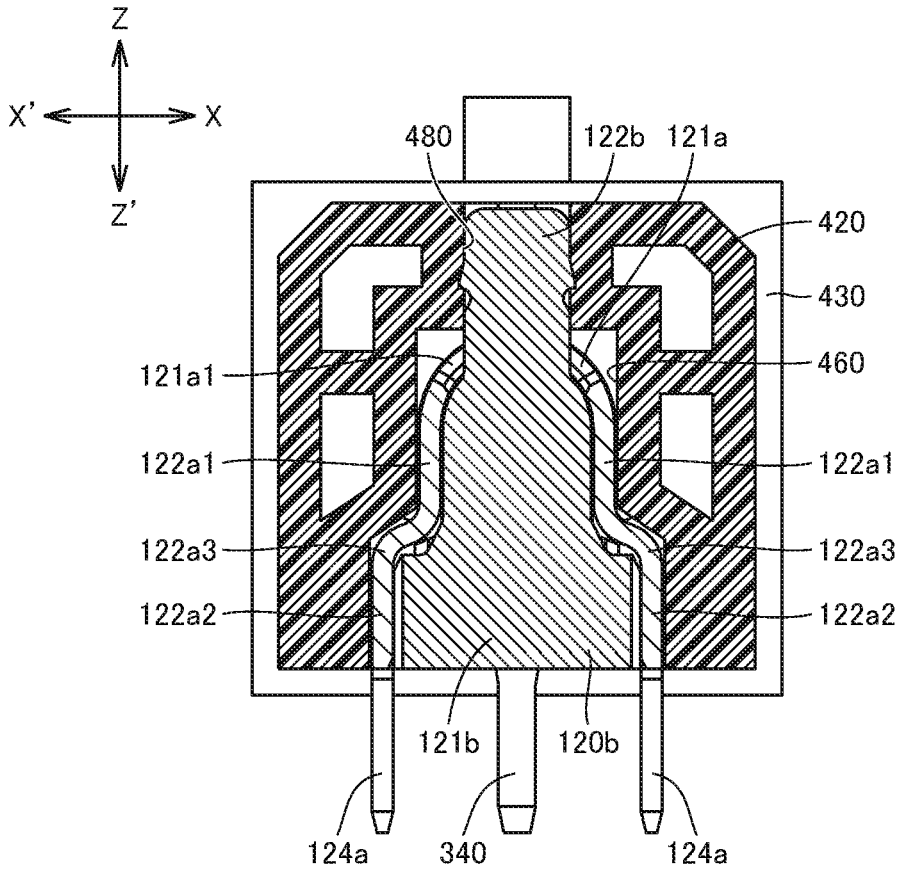
FIG. 2D is a sectional view of the connector, taken along 2D-2D in FIG. 2A.

The second shell 100*b* may further include a second blocking portion 120*b*. As best illustrated in FIG. 2D, the second blocking portion 120*b* is a metal plate extending in the Z-Z' and X-X' directions. The second blocking portion 120*b* includes a main body 121*b* and an engaging piece 122*b*. The main body 121*b* has a cross-sectional shape, on a plane containing the Z-Z' and X-X' directions, that corresponds to that of the cover 120*a*. The main body 121*b* is disposed on the Y'-direction side of the space between the walls 122*a* such as to block the space. The main body 121*b* abuts the inner faces of the upper walls 122*a*1 and the inner faces of the lower walls 122*a*2 of the walls 122*a*. The engaging piece 122*b* is a plate extending from the main body 121*b* in the Z direction. The engaging piece 122*b* has a protrusion protruding in the Y' direction. The engaging piece 122*b* has an X-X' direction dimension that is smaller than that of the engaging hole 121*a*1 of the cover 120*a*. The engaging piece 122*b* has a Y-Y' direction dimension (including the Y-Y' direction dimension of the protrusion) is slightly larger than the Y-Y' direction dimension of the engaging hole 121*a*1. The engaging piece 122*b* extends through and is engaged with the engaging hole 121*a*1 from the Z'-direction side, so that the main body 121*b* blocks the engaging hole 121*a*1 from the Z'-direction side.

Figure 2E:
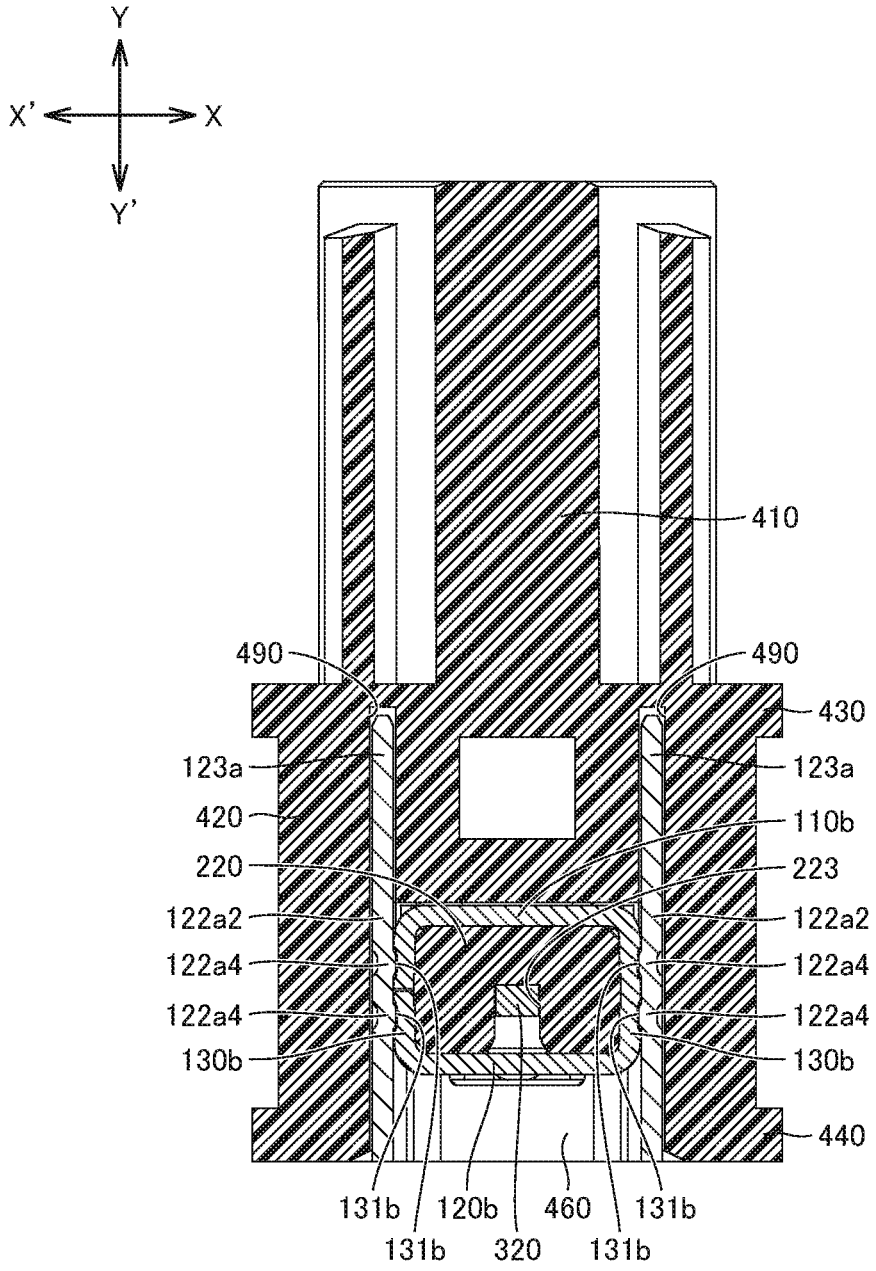
FIG. 2E is a sectional view of the connector, taken along 2E-2E in FIG. 2A.

The second shell 100*b* may further include a pair of walls 130*b* (walls of the second shell). As best illustrated in FIG. 2B and FIG. 2E, the walls 130*b* join together the first blocking portion 110*b* and the second blocking portion 120*b* such as to be located on the inner side relative to the lower walls 122*a*2 of the walls 122*a* of the first shell 100*a*, i.e. each located between each lower walls 122*a*2 and the lower portion 222 of the basal portion 220 of the body 200. The walls 130*b* may or may not be in surface contact with the lower walls 122*a*2 of the walls 122*a*. In the first embodiment, the walls 130*b* are in surface contact with the lower walls 122*a*2 of the walls 122*a*. In this case, the walls 130*b* each has a Z-Z' direction dimension that is substantially the same as or slightly smaller than that of the lower wall 122*a*2 of each wall 122*a*.

The walls 130*b* may include at least one engaging portion 131*b*. The walls 122*a* may include at least one engaging portion 122*a*4. One of the engaging portion 131*b* and the engaging portion 122*a*4 is an engaging protrusion, and the other is an engaging recess or an engaging hole. The engaging protrusion is engaged with the engaging recess or hole. In the first embodiment, as best illustrated in FIG. 2E, each engaging portions 122*a*4 is an engaging protrusion protruding inward (i.e. to the side of the adjacent wall 130*b*), and each engaging portion 131*b* is an engaging recess dented inward. In the first embodiment, a plurality of engaging portions 122*a*4 are provided on the lower wall 122*a*2 of each wall 122*a*, and a plurality of engaging portions 131*b* are provided on each wall 130*b*.

Disposed between the first blocking portion 110*b* and the second blocking portion 120*b* are the basal portion 220 of the body 200 and the second portion 320 of the terminal 300. Disposed between the walls 130*b* are a part of the lower portion 222 of the basal portion 220 and the second portion 320 of the terminal 300. The Y-Y' direction distance between the first blocking portion 110*b* and the second blocking portion 120*b* may be substantially equal to the Y-Y' direction dimension of the lower portion 222 of the basal portion 220 of the body 200. The X-X' direction distance between the walls 130*b* may be substantially equal to the X-X' direction dimension of the lower portion 222 of the basal portion 220. In other words, the first blocking portion 110*b*, the second blocking portion 120*b*, and the walls 130*b* defines a space adapted to fittingly house the lower portion 222 of the basal portion 220.

The case 400 is made of an insulating resin. The case 400 houses the terminal 300, the body 200, and the shield case 100. As illustrated in FIG. 1A to FIG. 3B, the case 400 includes a tube 410, a block 420, a plate 430, and another plate 440. The tube 410 extends from the plate 430 in the Y direction. A connecting hole 450 extends inside the tube 410. The connecting hole 450 is configured to receive a connecting portion of a mating connector. The block 420 is a rectangular parallelepiped body provided between the plate 430 and the plate 440.

A housing recess 460 is provided in the plate 440 and the block 420. The housing recess 460 has a shape conforming to the outer shape of the cover 120*a* of the shield case 100 to allow the cover 120*a* to fit in the housing recess 460. The housing recess 460 opens to the Y'-direction and the Z'-direction. The block 420 has an engaging hole 480 on the Z-direction side of the housing recess 460. The engaging hole 480 communicates with the housing recess 460, and also with the engaging hole 121*a*1 of the cover 120*a* as disposed in the housing recess 460. The engaging hole 480 is engaged with the engaging piece 122*b* of the second shell 100*b*. A communicating hole 470 is provided between and in communication with the connecting hole 450 and the housing recess 460 of the case 400. The communicating hole 470 has a shape conforming to the outer shape of the connecting portion 110*a* of the first shell 100*a*. The communicating hole 470 fits around a part of the connecting portion 110*a*. The connecting hole 450 houses the distal portion of the connecting portion 110*a*, the distal portion of the connecting portion 210 of the body 200, and the distal portion of the first portion 310 of the terminal 300. A pair of engaging holes 490 is provided on the Z'-direction side relative to the communicating hole 470 of the case 400. As best illustrated in FIG. 2E, the engaging holes 490 are engaged with the respective arms 123*a* of the first shell 100*a*.

The connector C in the first embodiment as describe above may be assembled in the following steps. First, the terminal 300 and the body 200 are prepared. The first portion 310 of the terminal 300 is press-fitted into the lock hole 212 of the body 200 from the Y'-direction side, and the bent portion 330 and the second portion 320 of the terminal 300 are inserted into the groove 223 of the body 200 from the Y'-direction side. Then, the middle portion of the first portion 310 of the terminal 300 is partially held in the lock hole 212, the distal portion of the first portion 310 is disposed in the connecting hole 211 of the body 200, and the rear portion of the first portion 310 is disposed on the middle portion 230 of the body 200. Also, the bent portion 330 and the second portion 320 of the terminal 300 are housed in the groove 223 of the body 200. The terminal 300 is thus held by the body 200.

The first shell 100*a* is also prepared. The body 200 is mounted into the first shell 100*a* in the following arrangements 1) to 4): 1) the connecting portion 210 of the body 200 fits into the connecting portion 110*a* of the first shell 100*a* from the Y'-direction side; 2) the first portion 310 of the terminal 300 is coaxially disposed inside the connecting portion 110*a* of the first shell 100*a;* 3) the basal portion 220 of the body 200, and the bent portion 330 and the second portion 320 of the terminal 300 are disposed inside the cover 120*a* of the first shell 100*a*; and 4) the upper portion 221 of the basal portion 220 of the body 200 is brought into surface contact with and engagement with the inner faces of the upper walls 122*a*1 of the cover 120*a*.

The case 400 is also prepared. The connecting portion 110*a* of the first shell 100*a* is inserted into the housing recess 460, the communicating hole 470, and the connecting hole 450 of the case 400 from the Y'-direction side in the following arrangements 1) to 3): 1) the connecting portion 110*a* is partially held in the communicating hole 470, and the distal portion of the connecting portion 110*a* is disposed inside the connecting hole 450; 2) the arms 123*a* of the first shell 100*a* are brought into engagement with the respective engaging holes 490 of the case 400; and 3) the cover 120*a* of the first shell 100*a* is housed in the housing recess 460 of the case 400, so that the engaging hole 121*a*1 of the cover 120*a* communicates with the engaging hole 480 of the case 400. The case 400 thus houses the first shell 100*a*, the terminal 300, and the body 200.

The second shell 100*b* is prepared. The second shell 100*b* is attached to the first shell 100*a* from the Z'-direction side in the following arrangements 1) to 8): 1) the distal portion 111*b* of the first blocking portion 110*b* of the second shell 100*b* fits between the second portion 112*a* of the connecting portion 110*a* of the first shell 100*a* and the walls 122*a*, and the first blocking portion 110*b* is also brought into abutment with the end face f1 of the second portion 122*a*, the end faces f2 of the walls 122*a*, and the end faces f3 of the roof 121*a* such as to block the interstices S between the end face f1 and the end faces f2; 2) the protruding portion 240 of the body 200 is fittingly held between the prongs of the U-shaped distal portion 111*b* of the first blocking portion 110*b* of the second shell 100*b;* 3) the first blocking portion 110*b* of the second shell 100*b* blocks the space between the walls 122*a* of the first shell 100*a*, on the Y-direction side relative to the basal portion 220 of the body 200; 4) the engaging piece 122*b* of the second blocking portion 120*b* is brought into engagement, from the Z'-direction side, with the engaging hole 121*a*1 of the first shell 100*a* and the engaging hole 480 of the case 400; 5) the second blocking portion 120*b* blocks the space between the walls 122*a* of the first shell 100*a*, on the Y'-direction side relative to the basal portion 220 of the body 200; 6) the walls 130*b* are placed on the inner side of the walls 122*a* such as to be in surface contact with the walls 122*a;* 7) the engaging portions 131*b* of the walls 130*b* are brought into engagement with the engaging portions 122*a*4 of the walls 122*a*; and 8) the basal portion 220 of the body 200 fits into the second shell 100*b*, and the second portion 320 of the terminal 300 is partially placed into the second shell 100*b*.

The above-described connector C has at least the following technical features. First, the connector C has improved EMC characteristics and improved voltage standing wave ratio (VSWR). This is because the first portion 310 of the terminal 300 is surrounded by the connecting portion 110*a* of the first shell 100*a*, and also because the bent portion 330 and the second portion 320 of the terminal 300 are surrounded by the cover 120*a* of the first shell 100*a* and the second shell 100*b*. More particularly, the first portion 310 of the terminal 300 is disposed inside the connecting portion 110*a* of the first shell 100*a* such as to be surrounded by the connecting portion 110*a*; the Z-direction portion of the bent portion 330 and the second portion 320 of the terminal 300 are covered by the roof 121*a* of the cover 120*a* of the first shell 100*a*, and the X- and X'-direction portions of the bent portion 330 and the second portion 320 of the terminal 300 are covered respectively by the walls 122*a* of the cover 120*a*; the Y-direction portion of the second portion 320 of the terminal 300 is covered by the first blocking portion 110*b*, which blocks the space between the walls 122*a*, of the first shell 100*a*; the Y'-direction portion of the bent portion 330 and the second portion 320 of the terminal 300 are covered by the second blocking portion 120*b*, which blocks the space between the walls 122*a*, of the first shell 100*a*; and the first blocking portion 110*b* blocks the interstices S between the second portion 112*a* and the walls 122*a*.

Second, the connector C exhibits sufficient EMC characteristics and VSWR even though the shield case 100 consists of two shells. The reason for this is as follows. Electrical connection between the first shell 100*a* and the second shell 100*b* is established by engaging the engaging piece 122*b* of the second shell 100*b* with the engaging hole 121*a*1 of the first shell 100*a*, and by bringing the walls 130*b* of the second shell 100*b* into surface contact with the walls 122*a* of the first shell 100*a*. As a result, the first shell 100*a* and the second shell 100*b* are at the same potential, so that the second shell 100*b* will not electrically float. Moreover, the surface contact between the walls 122*a* of the first shell 100*a* and the walls 130*b* of the second shell 100*b* means that the first shell 100*a* is electrically connected to the second shell 100*b* in the vicinity of the first legs 124*a* and/or the second legs 125*a*. As the first legs 124*a* and/or second legs 125*a* are connected to the ground, the first shell 100*a* is electrically connected to the second shell 100*b* in the vicinity of the ground. This arrangement improves the EMC characteristics and VSWR of the connector C.

Third, the connector C exhibits sufficient EMC characteristics and VSWR even though the second shell 100*b* is mechanically connected to the first shell 100*a*. This is because the engaging piece 122*b* of the second blocking portion 120*b* of the second shell 100*b* is engaged with the engaging hole 121*a*1 of the first shell 100*a*, so that the main body 121*b* of the second blocking portion 120*b* of the second shell 100*b* blocks the engaging hole 121*a*1.

Fourth, the connector C exhibits sufficient EMC characteristics and VSWR even though the shield case 100 is fixed to the case 400. A shield case is fixed to the case typically by engaging an engaging piece, which is formed by cutting and raising a part of the shield case, with an engaging hole or recess in the case. The cut-and-raised portion of the shield case leaves an opening in the shield case, and such an opening degrades EMC characteristics and VSWR of the connector. However, in the connector C, the engaging piece 122*b* of the second blocking portion 120*b* is designed for engagement with the engaging hole 480 in the case 400, as well as for engagement with the engaging hole 121*a*1 in the first shell 100*a*, and the engaging hole 121*a*1 is blocked with the second blocking portion 120*b*. This arrangement can obviate the need to cut and raise part of the first shell 100*a* or the second shell 100*b* to form an engaging piece for the purpose of fixing the shield case 100 to the case 400. It is therefore possible to suppress degradation of EMC characteristics of the connector.

The shield case and connector described above are not limited to the above embodiment but may be modified in any manner within the scope of the claims. Possible modifications will be described in detail below.

The shield case of the invention may be any shield case including first and second shells according to any one of the aspects described above or to be described.

The first shell of the invention may be any shell meeting the following requirements: 1) the first shell is electrically conductive; 2) the first shell includes a connecting portion, which is a tube extending in a first direction, and a cover; 3) the connecting portion of the first shell includes a first portion and a second portion, where the first portion is a portion of the connecting portion on one side in a second direction, the second portion is a portion of the connecting portion on the other side in the second direction, and the second direction crosses the first direction; and 4) the cover of the first shell extends in the first direction contiguously from the first portion of the connecting portion, and the cover includes a pair of walls opposed to the second portion, with interstices left between the walls and the second portion. The walls of the cover may only be the upper walls described above.

Figure 6:
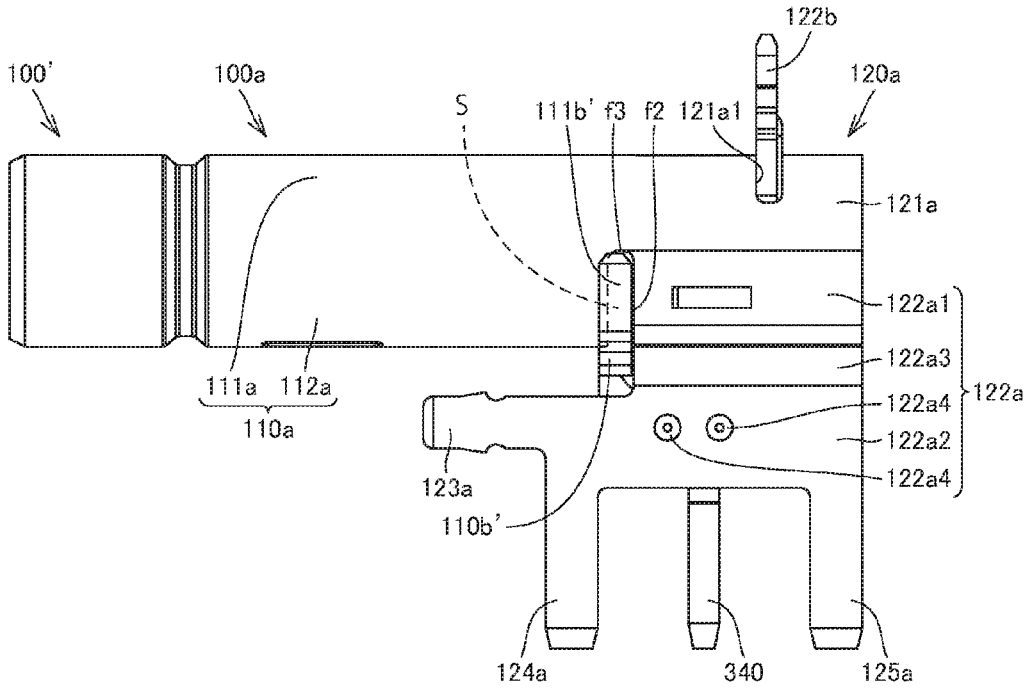
FIG. 6 is a left side view of a modified shield case.

The second shell of the invention may be any shell including a first blocking portion according to any one of the aspects described above or to be described. The first blocking portion of the invention may be any portion configured to block interstices between the second portion of the connecting portion and the walls of the cover of the first shell. For example, the first blocking portion may fit between the second portion of the connecting portion and the walls of the cover such as to abut on the opposing face of the second portion and the opposing faces of the walls. That is, the first blocking portion may not abut on the roof of the cover. Instead of fitting between the second portion of the connecting portion and the walls of the cover, the first blocking portion may abut on an outer face of the second portion and the opposing faces of the walls of the cover such as to block the interstices. An example of this modification is illustrated in FIG. 6. A variant shield case 100' is configured as follows: 1) A distal portion 111*b*' of a first blocking portion 110*b*' has a Y-Y' direction dimension that is larger than the Y-Y' direction dimension of each interstice S. 2) The U-shaped distal portion 111*b*' of the first blocking portion 110*b*' has a recessed face of a shape conforming to the outer face of the second portion 112*a* of the connecting portion 110*a*. Accordingly, the recessed face of the distal portion 111*b*' of the first blocking portion 110*b*' is in surface contact with the outer face of the second portion 112*a*. 3) The distal portion 111*b*' of the first blocking portion 110*b*' has an end face facing the walls of the cover, and this end face is in surface contact with the end faces f2 of the walls 122*a* of the cover 120*a*. The distal portion 111*b*', having features 1) to 4) above, completely blocks the interstices S. Other parts of the shield case 100' may be configured in the same manner as any one of the above aspects. The first blocking portion according to any one of the above aspects may not block the space between the walls of the cover.

The second blocking portion of the second shell of the invention, if provided, is disposed on the other side in the first direction of the space between the walls of the cover according to any one of the above aspects, and the second blocking portion may block this space completely or partially. The engaging piece of the second blocking portion and the engaging hole of the first shell can be omitted in the invention. The engaging piece of the second blocking portion of the invention may be engageable only with the engaging hole of the first shell. The main body of the second blocking portion of the invention may not block or may partially block the engaging hole of the first shell according to any one of the above aspects. The second blocking portion of the second shell of the invention can be omitted. If the second blocking portion is omitted, a rear cover may be provided at the roof and/or walls of the cover of the first shell. The rear cover may be disposed on the other side in the first direction of the space between the walls of the cover of the first shell such as to block this space.

The walls of the second shell of the invention can be omitted. The walls of the second shell of the invention, if provided, may be any walls inside or outside of the walls of the cover according to any one of the above aspects, joining together the first blocking portion according to any one of the above aspects and the second blocking portion according to any one of the above aspects. If the walls of the second shell are disposed outside the walls of the cover according to any one of the above aspects, they may be in surface contact with the outer faces of the walls of the cover. If the walls of the second shell are disposed outside the walls of the cover according to any one of the above aspects, one of the wall of the second shell or the wall of the cover is provided with an engaging protrusion, and the other is provided with an engaging recess or hole for engagement with the engaging protrusion. It is possible to omit the engaging portions of the walls of the cover of the first shell and the engaging portions of the walls of the second shell in the invention. The first legs and/or the second legs are provided in the first shell in the above embodiment. However, the first legs and/or the second legs may be provided in the second shell such as to extend in the Z' direction or the X-X' direction.

The body of the connector of the invention may be any member having electrical insulating properties, adapted to hold a terminal according to any one of the aspects described above or to be described and adapted to be housed in the shield case. For example, the body of the connector of the invention may not have the protruding portion between the interstices described above. In place of the protruding portion, at least one slit may be provided in the body of the connector of the invention. Such a slit or slits may communicate with at least one interstice. The first blocking portion according to any one of the above aspects may block the interstices and be engaged with the slit or slits.

The terminal of the connector of the invention may be any terminal configured to be held by the body according to any one of the above aspects and housed in the shield case according to any one of the above aspects. The connector of the invention may be provided with a plurality of terminals. For example, the plurality of terminals may be held in the body according to any one of the above aspects, and first portions of the terminals may be disposed in the connecting portion of the first shell of the shield case according to any one of the above aspects. The second portions of the terminals may be disposed between the first blocking portion and the second blocking portion of the second shell of the shield case according to any one of the above aspects.

The case can be omitted in the invention. The case of the invention, if provided, may be modified in any manner as long as it can house the terminal, the body and the shield case according to any one of the above aspects.

It should be appreciated that the shield case and the connector of the above embodiment and variants thereof are described above by way of examples only. The materials, shapes, dimensions, numbers, arrangements, and other configurations of the constituents of the shield case and the connector may be modified in any manner if they can perform similar functions. The configurations of the embodiment and the variants described above may be combined in any possible manner. The first direction of the invention may be any direction corresponding to the longitudinal direction of the connecting portion of the first shell of the invention. The second direction of the invention may be any direction crossing the first direction. The third direction of the invention may be any direction that crosses the first direction and the second direction and is non-coplanar with the plane including the first direction and the second direction.

Reference Signs List

- C: Connector
- 100: Shield case
  - 100a: First shell
    - 110a: Connecting portion
      - 111a: First portion
      - 112a: Second portion
        - f1: end face (opposing face)
    - 120a: Cover
      - 121a: Roof
        - 121a1: Engaging hole
          - f3: End face (abutting face)
      - 122a: Wall
        - 122a1: Upper wall
          - f2: End face (opposing face)
        - 122a2: Lower wall
          - 122a3: Bent portion
          - 122a4: Engaging portion
        - 123a: Arm
        - 124a: First leg
        - 125a: Second leg
      - S: Interstice
    - 100b: Second shell
      - 110b: First blocking portion
        - 111b: distal portion
          - 111b1: Lug
        - 112b: basal portion
      - 120b: Second blocking portion
        - 121b: Main body
        - 122b: Engaging piece
      - 130b: Wall
        - 131b: Engaging portion
    - 200: body
      - 210: Connecting portion
        - 211: Connecting hole
        - 212: Lock hole
      - 220: Basal portion
        - 221: Upper portion
        - 222: Lower portion
        - 223: Groove
      - 230: Middle portion
      - 240: Protruding portion
  - 300: Terminal
    - 310: First portion
    - 320: Second portion
    - 330: Bent portion
    - 340: Tail
  - 400: Case
    - 410: Tube
    - 420: Block
    - 430: Plate
    - 440: Plate
    - 450: Connecting hole
    - 460: Housing recess
    - 470: Communicating hole
    - 480: Engaging hole
    - 490: Engaging hole

The invention claimed is:

1. A shield case comprising:

a first shell having electrical conductivity; and a second shell having electrical conductivity, wherein the first shell includes a connecting portion and a cover, the connecting portion is a tube extending in a first direction and including:

a first portion being a portion of the connecting portion on one side in a second direction, the second direction crossing the first direction, and a second portion being a portion of the connecting portion on the other side in the second direction, the cover extends in the first direction contiguously from the first portion of the connecting portion and includes a pair of walls opposed to the second portion, with interstices left between the respective walls and the second portion, and the second shell includes a first blocking portion, the first blocking portion blocking the interstices, the second portion of the connecting portion includes an opposing face opposed to the walls of the cover with the interstices therebetween, the walls of the cover include opposing faces opposed to the second portion of the connecting portion with the interstices therebetween, and the first blocking portion fits between the second portion and the walls such as to abut on the opposing face of the second portion and the opposing faces of the walls.

2. The shield case according to claim 1, wherein the cover further includes a roof extending in the first direction contiguously from the first portion of the connecting portion, the roof includes first and second end portions in a third direction, the third direction crossing the first and second direction, the first and second end portions each having an abutting face located on one side in the second direction of each interstice, the walls of the cover respectively extend from the first and second end portions of the roof to the other side in the second direction, and the first blocking portion fits between the second portion and the walls such as to abut on the opposing face of the second portion, the opposing faces of the walls, and the abutting faces of the roof.

3. The shield case according to claim 2, wherein the first blocking portion is located on one side in the first direction of a space between the walls such as to block the space, and the second shell further includes a second blocking portion, the second blocking portion is located on the other side in the first direction of the space between the walls such as to block the space.

4. The shield case according to claim 3, wherein the cover of the first shell has an engaging hole, and the second blocking portion includes an engaging piece to be engaged with the engaging hole from the other side in the second direction.

5. The shield case according to claim 1, wherein the first blocking portion is located on one side in the first direction of a space between the walls such as to block the space, and the second shell further includes a second blocking portion, the second blocking portion is located on the other side in the first direction of the space between the walls such as to block the space.

6. The shield case according to claim 5, wherein
the cover of the first shell has an engaging hole, and
the second blocking portion includes an engaging piece to be engaged with the engaging hole from the other side in the second direction.

7. The shield case according to claim 6, wherein
the second blocking portion further includes a main body, the main body blocking the engaging hole of the first shell from the other side in the second direction.

8. A shield case comprising:
a first shell having electrical conductivity; and
a second shell having electrical conductivity, wherein
the first shell includes a connecting portion and a cover,
the connecting portion is a tube extending in a first direction and including:
a first portion being a portion of the connecting portion on one side in a second direction, the second direction crossing the first direction, and
a second portion being a portion of the connecting portion on the other side in the second direction,
the cover extends in the first direction contiguously from the first portion of the connecting portion and includes a pair of walls opposed to the second portion, with interstices left between the respective walls and the second portion, and
the second shell includes a first blocking portion, the first blocking portion blocking the interstices,
the first blocking portion is located on one side in the first direction of a space between the walls such as to block the space, and
the second shell further includes a second blocking portion, the second blocking portion is located on the other side in the first direction of the space between the walls such as to block the space.

9. The shield case according to claim 8, wherein
the cover of the first shell has an engaging hole, and
the second blocking portion includes an engaging piece to be engaged with the engaging hole from the other side in the second direction.

10. The shield case according to claim 9, wherein
the second blocking portion further includes a main body, the main body blocking the engaging hole of the first shell from the other side in the second direction.

11. A connector comprising:
the shield case according to claim 10;
a body having an insulating property and being housed in the shield case;
a terminal generally of L-shape, the terminal being held by the body; and
a case having an insulating property, the case housing the shield case and having an engaging hole in communication with the engaging hole of the first shell, wherein
the engaging piece of the second blocking portion is engaged with the engaging hole of the first shell and the engaging hole of the case.

12. A connector comprising:
the shield case according to claim 9;
a body having an insulating property and being housed in the shield case;
a terminal generally of L-shape, the terminal being held by the body; and
a case having an insulating property, the case housing the shield case and having an engaging hole in communication with the engaging hole of the first shell, wherein
the engaging piece of the second blocking portion is engaged with the engaging hole of the first shell and the engaging hole of the case.

13. The shield case according to claim 8, wherein
the second shell further includes a pair of walls, and
the walls of the second shell each couple the first blocking portion and the second blocking portion, are disposed inside or outside the walls of the cover, and are in surface contact with the respective walls of the cover.

14. A connector comprising:
the shield case according to claim 8;
a body having an insulating property and being housed in the shield case; and
a terminal generally of L-shape, the terminal being held by the body and including:
a first portion extending in the first direction such as to be disposed in the connecting portion of the first shell of the shield case; and
a second portion extending to the other side in the second direction, the second portion of the terminal being disposed between the walls of the first shell and between the first and second blocking portions of the second shell.

15. A shield case comprising:
a first shell having electrical conductivity; and
a second shell having electrical conductivity, wherein
the first shell includes a connecting portion and a cover,
the connecting portion is a tube extending in a first direction and including:
a first portion being a portion of the connecting portion on one side in a second direction, the second direction crossing the first direction, and
a second portion being a portion of the connecting portion on the other side in the second direction,
the cover extends in the first direction contiguously from the first portion of the connecting portion and includes a pair of walls opposed to each other in a third direction and opposed to the second portion in the first direction, with interstices left between the respective walls and the second portion, the third direction crossing the first and second directions, and
the second shell includes a first blocking portion, the first blocking portion blocking the interstices in the second direction.

16. The shield case according to claim 15, wherein
the second portion of the connecting portion has an outer face, the walls of the cover have opposing faces opposed to the second portion of the connecting portion with the interstices left therebetween, and the first blocking portion abuts on the outer face of the second portion and the opposing faces of the walls such as to block the interstices.

17. The shield case according to claim 16, wherein
the first blocking portion is located on one side in the first direction of a space between the walls such as to block the space, and
the second shell further includes a second blocking portion, the second blocking portion is located on the other side in the first direction of the space between the walls such as to block the space.

18. The shield case according to claim 17, wherein
the cover of the first shell has an engaging hole, and
the second blocking portion includes an engaging piece to be engaged with the engaging hole from the other side in the second direction.

19. A connector comprising:
the shield case according to claim 15;
a body having an insulating property and being housed in the shield case; and a terminal generally of L-shape held by the body and housed in the shield case.

20. The connector according to claim 19, wherein the first blocking portion of the second shell is fixed to the body.

21. The shield case according to claim 15, wherein the first blocking portion is disposed between the second portion and the walls.

* * * * *